United States Patent [19]

Shipman

[11] Patent Number: 4,832,066

[45] Date of Patent: May 23, 1989

[54] HYDRO CENTRIFUGAL PAINT ROLLER CLEANING AID

[76] Inventor: David O. Shipman, 11380 Heartpine St., Reno, Nev. 89506

[21] Appl. No.: 22,122

[22] Filed: Mar. 5, 1987

[51] Int. Cl.[4] ..... B08B 3/02

[52] U.S. Cl. ..... 134/137; 134/138; 134/151; 134/198; 134/200; 68/213

[58] Field of Search ..... 134/138, 137, 143, 151, 134/155, 198, 200; 68/213

[56] References Cited

U.S. PATENT DOCUMENTS

| | | | |
|---|---|---|---|
| 2,938,368 | 5/1960 | Bixel | 134/138 X |
| 3,139,891 | 7/1964 | Faustman | 134/138 |
| 3,428,060 | 2/1969 | Spivey | 134/138 X |
| 3,577,280 | 5/1971 | George | 134/138 |
| 3,688,785 | 9/1972 | Stevens et al. | 134/138 |
| 3,886,960 | 6/1975 | Krueger | 134/138 |
| 3,897,797 | 8/1975 | Wright et al. | 134/138 X |
| 4,142,540 | 3/1979 | Vegiard | 134/138 |
| 4,402,333 | 9/1983 | Frizzell et al. | 134/138 |
| 4,641,673 | 2/1987 | Connley et al. | 134/138 |

FOREIGN PATENT DOCUMENTS

| | | | |
|---|---|---|---|
| 2360884 | 6/1975 | Fed. Rep. of Germany | 134/138 |

*Primary Examiner*—Harvey C. Hornsby
*Assistant Examiner*—Frankie L. Stinson

[57] ABSTRACT

A device for performing controlled cleaning of paint rollers of a hollow tubular form, comprising a housing (6, 7) for containing fluid transport tubing and spray heads (3, 4) spray heads (4) for expelling high pressure spray, which is directed at the sides of said paint roller thereof producing a spinning action. Fluid transport tubing (3) is in fluid communication through the wall of lower housing (6) with gate valve and female coupling housing (2, 1) supplying fluid to spray heads (4). A funnel (5) functions for collection and downward channeling waste fluid, and is mounted circumferentially inside and just below the top rim of lower housing (6) with the spout portion pointing downward, allowing for convenient single stream drainage of waste fluid. An exterior bracket mean (8, 9) for supporting the handle portion of said paint roller horizontally and outside of housing (6, 7) wherein the roller portion is affixed vertically and inside of housing (6, 7) between two vertical fluid transport tubes (3) comprising spray heads (4).

16 Claims, 3 Drawing Sheets

HYDRO CENTRIFUGAL PAINT ROLLER CLEANING AID

BACKGROUND

1. Field of Invention

This invention pertains to paint roller cleaning, and is specially designed to facilitate easy cleaning of paint rollers thereof and to allow the user to not make any contact with the soiled roller.

2. Description of Prior Art

Many, if not most users of paint rollers of the non disposable type, are faced with the inevitable chore of cleaning it, in the case of latex paints this is accomplished by pulling the roller portion (which is coated with paint) off of the handle portion and holding it under a running faucet, the user then has to scrub it and rinse it repeatedly until the water eventually runs clear from the roller, this is a long, tedious and messy process that usually leaves the roller in less than satisfactory condition for reuse, and normally leaves the user with a second cleaning job of the cleaning area and him or herself.

Heretofore a variety of paint roller cleaners have been proposed for said purpose.

To date, six patents have been granted for devices designed to do the job of paint roller cleaning, all six cleaners obtain this purpose with a reasonable degree of efficiency, though there are some drawbacks wherein the user may regard these cleaners as unsatisfactory, out of the six patents mentioned, five of them require the user to make contact with the soiled roller with the hands, in order to remove the roller from the roller applicator and to place it onto a support device mounted inside the cleaners, these roller support devices are of the same basic design and function as the type used on all roller applicators, also of the five patents mentioned there is another drawback to which they all have in common, a plurality of both moving and stationary parts are required in order for the cleaners to perform their function properly, this could be a problem for the manufacturing aspect, wherein cost effectivness is of the utmost importance, also there is the high maintenance factor for the user due to the large number of stationary and moving parts.

The one paint roller cleaner of the six not yet mentioned, does allow for the roller to remain on the handle to be cleaned, and does not comprise any moving parts, there are some disadvantages to the user though, for the paint roller to be cleaned the user must manually support the roller applicator in the cleaning device and move it in an up and down motion to thoroughly cover the roller with the high pressure spray, also the spray is expelled by means of a circumferentially mounted tube positioned on the inside wall of the cleaner, another disadvantage to the user is that the fluid intake canot be controlled locally by means of a built in gate valve, in short, both hands of the user are needed throughout the intire cleaning process.

Most users, therefore, would find it desirable to have a paint roller cleaner that is simple in design and function and can facilitate in the cleaning of a paint roller more easily.

OBJECTS AND ADVANTAGES

Accordingly I claim the following as my objects and advantages of the invention: to provide a device for easily, reliably, and neatly cleaning the paint from a paint roller, regardless of the thickness or the diameter of such paint roller, to provide a device for cleaning paint rollers comprising a hollow tubular form with a foam or fiberous veneer of synthetic or natural material, to provide such a device which requires a minimum of skill and training to use, and to provide such a device which can do a complete job of cleaning without the need to make any contact with the soiled roller, and to allow the user to have both hands free during the cleaning process.

In addition I claim the following additional objects and advantages: to provide a paint roller cleaner that can accommodate the intire paint roller applicator by means of a bracket mounted to the outside of the cleaning device, wherein the handle portion of the applicator is straped securely to the bracket with the roller portion positioned vertically and in the center of the cleaning device.

Readers will find further objects and advantages of the invention from a consideration of the ensuing description and the accompanying drawings,

DRAWING FIGURES

DRAWING REFERENCE NUMERALS

Figure 2:
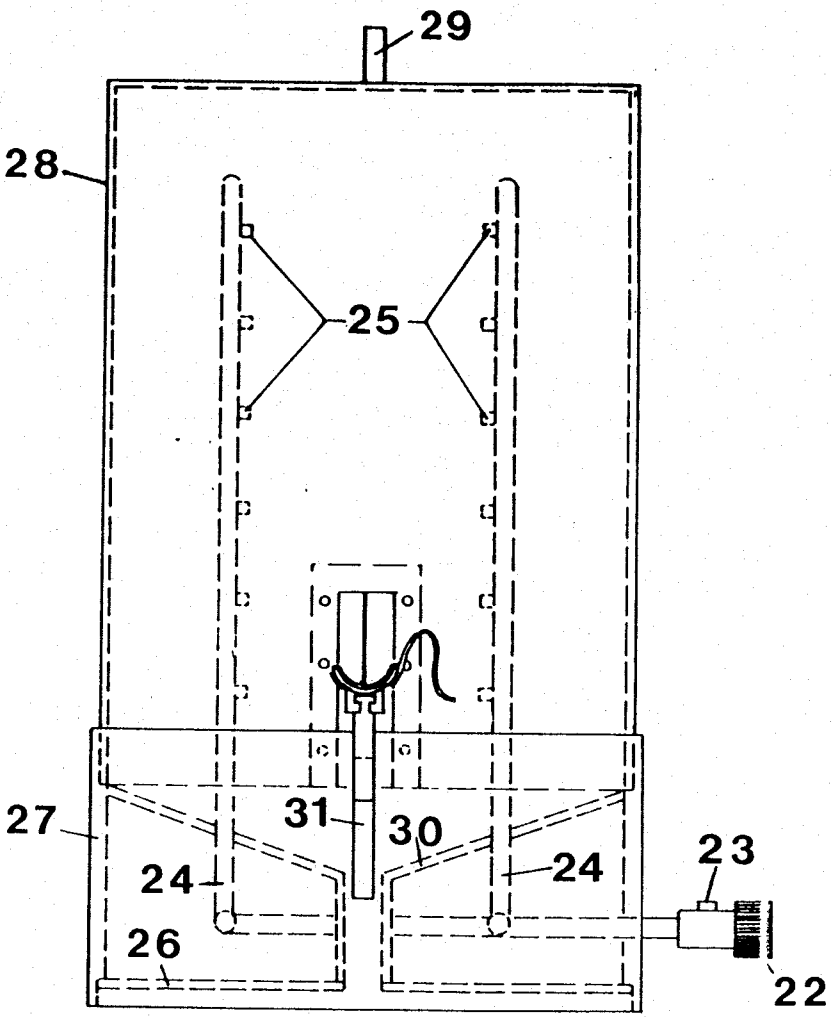
FIG. 2 shows a back side view of such apparatus.

1 female coupling
2 gate valve
3 fluid transport tubing
4 spray heads
5 funnel
6 lower housing
7 upper housing
8 radial trough
9 dihedral arch
10 straps
11 foam rubber veneer
12 handle
13 disc covering
14 slide mount
15 velcro fasteners
16 rabbet
17 vertical slot
18 square rails
19 square grooves
20 weather striping
21 rectangular plate

Two-Piece Device—Description

Figure 1:
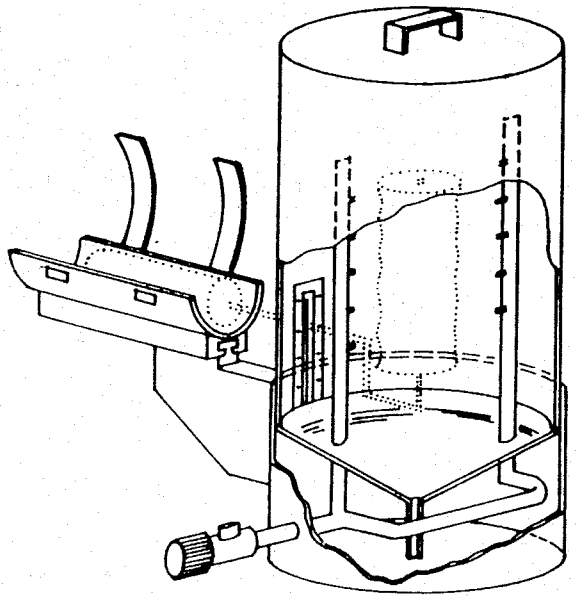
FIG. 1 shows a perspective side, frontal, elevational view of a two piece apparatus according to the invention, and of such apparatus in use.
Figure 3:
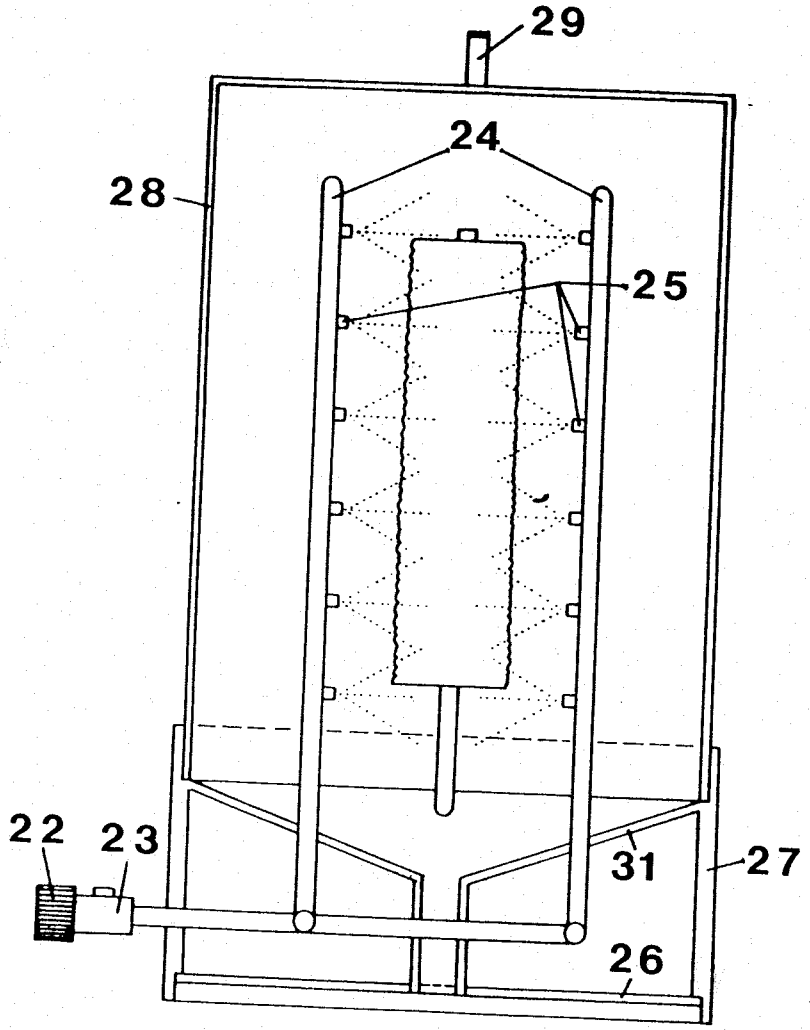
FIG. 3 shows a front side view of such apparatus.
Figure 7:
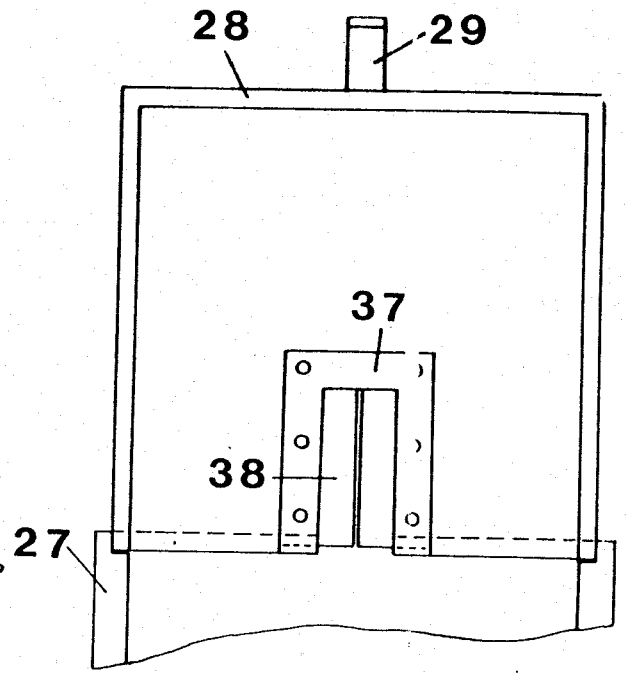
FIG. 7 shows an inside cut away view of the cover, upper base weather striping and plate.

FIG. 1 shows a two-piece device according to the preferred embodiment of the invention. The invention comprises a female coupling 1 and a gate valve 2 which are of one integrated housing, and joined with the fluid transport tubing through the wall of the lower housing 6. The female coupling 1 comprises a standard threading to accommodate the male end of a standard garden hose. The fluid transport tubing 3 comprises a horizontal tube integrally joined with two vertical tubes of the same type that are caped at the tops, this is best seen in FIGS. 2 and 3. The two vertical tubes 3 comprise a series of evenly spaced spray heads 4 that are aligned vertically and point toward the center of the device at a slight oblique. The spray heads 4 are of the type that produce a half circle fan shaped pattern, and are positioned so the spray is expelled vertically. This process is best seen in FIGS. 1 and 3.

Funnel portion 5 is joined with the bottom horizontal ledge of rabbet portion 16, wherein the outside diameter of the top rim of the funnel 5 is the same as the inside diameter of the bottom horizontal ledge of rabbet 16. Funnel 5 and horizontal ledge of rabbet 16 are joined in a permanent seal at the point of contact where the top edge of the funnel 5 is flush with the horizontal ledge of the rabbet 16. This is best seen in FIGS. 2 and 3.

Upper housing portion 7 is placed into lower housing 6 serving as a splash containment when the cleaning device is in operation. The outside diameter of the upper housing 7 is the same as the inside diameter of the vertical wall of the rabbet 16, this provides for a tight fit when the upper housing 7 is placed vertically into rabbet portion 17. When upper housing 7 is placed into rabbet portion 16, the inside wall of the upper housing 7 meets with the beginning downward sloping wall of the funnel 5, thereby creating a continuous wall. The functions of referance nomerals 5, 6, 7, and 16 are best seen in FIGS. 1, 2, and 3.

Figure 4:
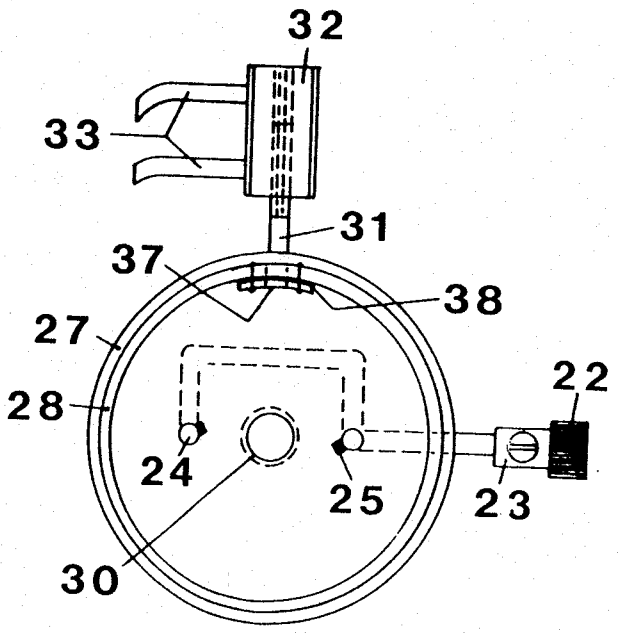
FIG. 4 shows a top view of such apparatus.
Figure 6:
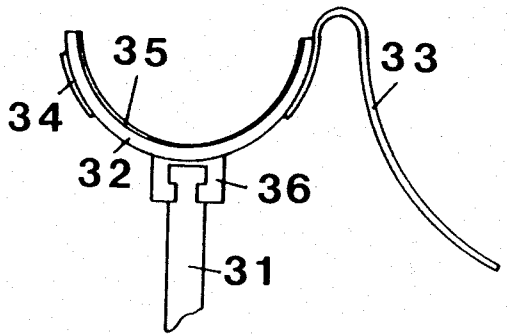
FIG. 6 shows a close up back side view of the roller handle support and gusset.
Figure 5:
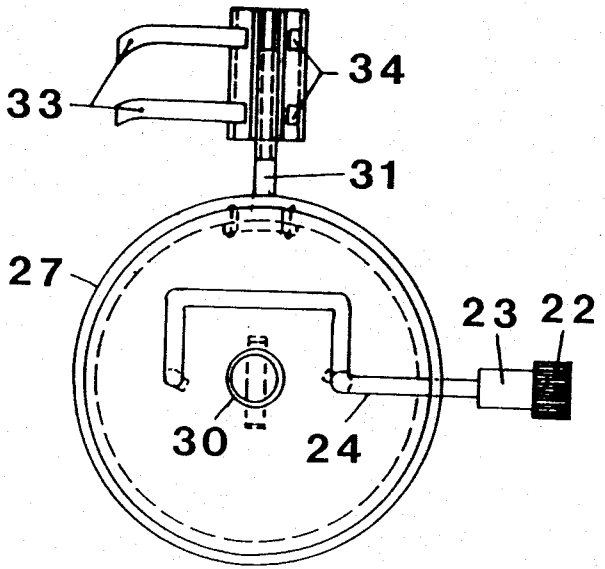
FIG. 5 shows a bottom view of such apparatus.

Radial trough 8 is joined with dihedral arch 9 by means of the slide mount 14 that is open downward and comprising two square rails 18 that run the horizontal length of the inside bottom two edges, and face toward each other. Rectangular trough 14 is integrally joined with radial trough 8 thereof forming one piece. Square rails 18 slide into two square grooves 19 that are positioned near the top and on both sides of the dihedral arch 9. The functions of reference numerals 8, 9, 14, 18, and 19 are best seen in FIGS. 1, 2, 4, 5, and 6. Radial trough 8 further comprises two straps 10 and a foam rubber veneer 11, the two straps 10 are fastened on one side of the radial trough 8 and about ½ inch from the ends, the foam rubber veneer 11 is laminated to the intire concaved surface of radial trough 8 and serves as a high friction contact for the paint roller handle. The two straps 10 are then brought over the top of the paint roller handle and fastened to the other side of the trough 8 by means of two velcro fasteners 15 positioned directly opposite the straps. This is best seen in FIGS. 4, 5, and 6.

Handle portion 12 is mounted in the center of the top horizontal flat portion of upper housing 7 and allows for easy lifting of the upper housing with one hand.

Vertical slot portion 17 comprises a thin rubber weather striping 20 of one piece, and with a slit running the length and stoping about ¼ inch from one end. The weather striping 20 is held in place with a rectangular plate 21 that comprises a rectangular output portion that is the same hight and width as the vertical slot 17. The weather striping 20 is sandwiched between the rectangular plate 21 and the inside wall of the upper housing 7, exposing the slit vertically and in the center of the vertical slot 17.

Two-Piece Device—Operation

The two-piece device of FIG. 1 is designed spacifically for the function of cleaning paint rollers, users will find it most eficiant for this purpose. For this function, users should employ radial trough 8 gate valve 2 straps 10 and female coupling 1.

Adjustable Device

To clean a paint roller, the user should place the handle of a paint roller applicator into radial trough portion 8 securing it into place with straps 10 the roller applicator should be positioned so the metal bar portion is angled downward with the roller portion standing vertically in the approximate center of the lower housing 6. The user will then find the slide mount 14 useful for aligning the roller portion of the applicator between the two vertical tubes of 3, this feature will allow for the accommodation of a large variety in lengths of paint roller handles.

Cleaning Device

After adjusting the roller into the desired position between the two vertical tubes of 3, the user should then take upper housing 7 by handle portion 12 and place it over the top of the roller with vertical slot portion 17 aligned with the metal bar portion of the roller aplicator. Upper housing 7 should then be lowered into rabbet portion 16 of lower housing 6, wherein weather striping portion 20 of vertical slot 17 slides around both sides of the metal bar portion of the roller applicator by means of a vertical slit, thereof creating a fluid tight seal.

Next, the user employs female coupling 1 by connecting it to the male end of a garden hose or the like, gate valve 2 should then be turned to the off position wherein the user can then turn on the main fluid supply. The cleaner is ready for operation. The user can now conveniently control the fluid intake locally by means of gate valve 2, by turning it to the on position fluid is supplied to the spray heads 4 by means of fluid transport tubing 3. Spray heads 4, then expell fluid in a high pressure vertical half circle pattern toward the sides of the paint roller, causing it to spin at a very high velocity, thus throwing the paint (which is mixing with fluid) off by centrifugul force. Upper housing 7 is comprised of transparant plastic which allows the user to see the roller during the cleaning process, and to easilly tell when the roller is clean. When the roller first begins to spin, upper housing 7 will turn the collor of the paint being cleaned, within seconds though, upper housing 7 will start turning clear again, the user will know it is clean. The user can then shut off gate valve 2, the roller will remain spinning for a few more seconds, throwing off most of the exess fluid, The user will see when the roller is removed, that it is not only cleaner than it would be if cleaned manually, but also in better paint ready condition. This is due to the spinning, wherein centrifugul force causes the nap to stand up, thereby allowing the roller to dry better, consequently absorbing more paint. Upper housing 7 also serves as a splash enclosure.

The function of disc portion 13 is to provide a covering of the fluid transport tubing, and as a support for the spout portion of funnel 5.

While the above discription contains many specificities, the reader should not construe these as limitations on the scope of the invention, but merely as exemplifications of prefered embodiments thereof, the materials and shape of the device described can almost be limitless, and still obtain the primary function and purpose that has been described in this application. Furthermore wherein paint comprising a water base, has been referred to throughout the application as the substance to be cleaned, it is only intended to be one example from a wide variety of water based substances that can be applied with a paint roller. For example, non toxic contact cement, used in laminating formica or the like. Accordingly the reader is requested to determine the scope of the invention by the appended claims and their legal equivalents, and not by the examples which have been given.

I claim:

1. A device for performing a function of paint roller cleaning, for use with a paint roller applicator having a metal bar portion an axle and a handle of hollow tubular form with a roller having a foam of fiberous veneer of synthetic or natural materials comprising:

A. a cylindrically-shaped walled housing of two independent sections, forming a upper and a lower housing having an inside diameter;

B. two elongated tubes mounted vertically within the upper housing and in fluid communication with a horizontally mounted elongated tube that is mounted within the lower housing, said tubes functioning as a main fluid transport system, which further comprises a female coupling means and a gate valve integrally joined in one housing, said main fluid transport system being joined through said wall of said lower housing and fluid communication with said female coupling and gate valve;

C. a funeral having an upper rim such that the outside diameter of the upper rim of said funnel is proportionally the same diameter as the inside diameter of said lower housing, wherein said funnel is mounted below a top rim of said lower housing for collecting and downwardly channeling waste fluid;

D. an exterior bracket means having two ends and two sections for supporting the handle of the paint roller applicator, one section comprising a dihedral arch having a top portion, said dihedral arch being mounted to a side of the lower housing, the other section comprising an elongated trough of radian shape being concaved upwardly and horizontally mounted to the top portion of said dihedral arch wherein one of said bracket's end is facing diametrically to said lower housing, said exterior bracket functioning as a main support and further comprising an open ended rectangular trough means terminating into two bottom edges with the open end facing downwardly, said rectangular trough being integrally joined at a bottom portion of said radian trough, said rectangular trough having the same inside width as the thickness of said dihedral arch and also comprising two square rails that run the length of rectangular trough on opposing inside walls of the rectangular trough and at the bottom edges of said rectangular trough.

2. The paint roller cleaner of claim 1 wherein the two independent sections of the housing are releasably joined vertically by rabbet means cut along the inside circumference of the top rim of said lower housing is joined to the lower housing in a fluid-tight fit.

3. The paint roller of claim 2 wherein said upper housing comprises an opened end bottom and a closed top end, said open end is further characterized by a rectangular slot which extends vertically to accommodate the metal bar portion of the paint roller handle.

4. The paint roller cleaner of claim 3 wherein said upper housing comprises a disc of the same thickness and material of the upper housing and is permanetly fixed to the upper housing to close off the upper housing's top end in a fluid tight fit, said disc further comprises a handle mounted to the center thereof to accommodate a user hand.

5. The paint roller cleaner of claim 1 wherein said vertically mounted tubes direct high pressure fluid toward the sides of the paint roller by means of a plurality of vertically spaced nozzles facing the roller at a slight angle offset from the axis of the roller to thereby strike the side of the paint roller tangentially with high pressure fluid causing the roller to spin at high velocity.

6. The paint roller cleaner of claim 5 wherein the two vertically mounted tubes are mounted parallel to each other at a proper spacing to accomodate rollers of different diameters.

7. The paint roller cleaner of claim 5 wherein said nozzles are of the type where the fluid is expelled in a half-circle fan line pattern providing for a complete and thorough covering of said paint roller.

8. The paint roller cleaner of claim 5 wherein said paint roller is positioned vertically in the upper housing allowing for free spinning and positioned between the two vertical tubes allowing for a centrifugal force to aid in the cleaning of the paint roller.

9. The paint roller cleaner of claim 8, wherein the free spinning is accomplished by said axle of the paint roller during the cleaning thereof which allows the paint roller to be independent of the paint roller cleaner.

10. The paint roller cleaner of claim 1 wherein the funnel collects and channels downwardly waste fluid as a single stream emptying into the lower housing to thereby allow for direct drainage of the waste fluid into a sink drain or the like.

11. The paint roller cleaner of claim 10 wherein the funnel's sloped wall creates a continuous wall for continuous flow of waste fluid without any obstruction.

12. The paint roller cleaner of claim 1 wherein said exterior bracket which supports the handle portion of the paint roller has the dihedral arch section mounted vertically to an outside wall of said lower housing.

13. The paint roller cleaner of claim 12 wherein said radian trough is further characterized by a concave portion of thin foam rubber veneer cradled in the radian trough for high friction contact when the paint roller's handle is placed into the radian trough and two straps fixed to one side of the radian trough which are adapted to be brought over the paint rollers handle once the handle is placed in the radian trough and fastened to the opposite side of the radian trough by two Velcro pads thereby holding the paint roller tightly and in a stationary position.

14. The paint roller cleaner of claim 12 wherein said rectangular trough comprises two square rails, said rails being capable of sliding into place at the top of said dihedral arch by means of two square grooves that run the horizontal length of a top portion of said dihedral arch on both sides thereby allowing the radian trough to slide horizontally in both a forward and a backward motion providing a quick and simple adjustment for accommodating a large variety of lengths in said paint roller handles.

15. The paint roller cleaner of claim 1 wherein said horizontally mounted tube functions as a main fluid input, and further comprising a female coupling and gate valve combined in one housing and in fluid communication through the wall of said lower housing and said horizontally tube is integrally joined to said vertically mounted tubes.

16. The paint roller cleaner of claim 15 wherein said gate valve is used for manipulation of the fluid input.

* * * * *